United States Patent [19]

Fiducia

[11] 4,191,302

[45] Mar. 4, 1980

[54] CHILD'S DRINKING CONTAINER

[76] Inventor: Christopher S. Fiducia, 181 Avenue A, Holbrook, N.Y. 11741

[21] Appl. No.: 15,164

[22] Filed: Feb. 26, 1979

Related U.S. Application Data

[63] Continuation-in-part of Ser. No. 850,417, Nov. 10, 1977, abandoned.

[51] Int. Cl.[2] ..... A47G 19/22

[52] U.S. Cl. ..... 220/1 R; 215/1 A; 220/90.2; 229/75; D7/6; D7/11; D7/13

[58] Field of Search ..... 220/1 R, 90.2, 90.4, 220/90.6, ; 229/75; 215/1 A, 99.5; D7/11, 13, 6.42; 239/33; 128/222

[56] References Cited

U.S. PATENT DOCUMENTS

| | | | |
|---|---|---|---|
| 162,640 | 4/1875 | Fowler | 215/99.5 |
| D.217,001 | 3/1970 | Stone | D7/13 |
| 794,996 | 7/1905 | Mimmack | 228/222 |
| 1,215,823 | 2/1917 | Lewis | 128/222 |
| 2,063,803 | 12/1936 | Gildersleeve | 239/33 |
| 2,223,528 | 12/1940 | Owen | 229/75 |
| 2,687,628 | 8/1954 | Cunningham | 220/90.6 |
| 3,425,626 | 2/1969 | Dietz . | |
| 3,645,262 | 2/1972 | Harrigan | 128/222 |
| 3,774,804 | 11/1973 | Henning | 229/75 |

FOREIGN PATENT DOCUMENTS

| | | | |
|---|---|---|---|
| 3124 | of 1897 | United Kingdom | 220/90.2 |

*Primary Examiner*—George E. Lowrance
*Attorney, Agent, or Firm*—Michael I. Kroll

[57] ABSTRACT

A container with a drinking straw is provided. The container consists of a helix-shaped transparent container for the storage of the drinking liquid. The base of the helix-shaped transparent container is flat for a portion of its circumference in order that it will stand upright on a table. Affixed to the base of the container is a transparent spiral-shaped drinking straw for drinking the liquid in the container the top of said straw being level or higher than the top of the container in order to retain the liquid in the container when not being used. Thus the container is an attractive and convenient vessel in which to drink and store liquids for novelty as well as medical uses.

2 Claims, 3 Drawing Figures

CHILD'S DRINKING CONTAINER

BACKGROUND AND DISCUSSION OF PRIOR ART

This is a continuation-in-part of application Ser. No. 850,417 filed Nov. 10, 1977, now abandoned.

Numerous shapes of drinking straws are described in the prior art, namely, U.S. Pat. No. 3,425,626 and the references cited thereon. However, none of these provide an integral transparent container and transparent straw which device provides a novelty item in several ways.

The novelty of the instant invention is not only in the drinking of the liquid but evidences itself when filling the container with the liquid as well as acting as a storage container for later use.

Very often it is difficult for a parent to convince a child of tender years that the child shoud drink milk, juice or alike. With the instant invention however the child will be fascinated with the visual flow of the drink in the container which will in turn make the child amenable to drinking the contents. The visual effect of this invention is fascinating to a child both during its filling in preparation for use and during the use itself. The invention also serves as a sanitary storage container for any remaining unconsumed liquid.

The invention can also be used in conjunction with a nasogastric tube for feeding patients who cannot consume food in the normal manner.

Children suffering from anorexia or other dietary deficiencies will find the novelty of this invention conducive to consuming their daily nutrient requirements.

The prior art exhibits examples of drinking straws and containers but none are as novel, unique and useful as the instant invention. Henning U.S. Pat. No. (3,774,804) shows a disposable container and straw combination, it being apparent that Henning's removable tab 34 can not readily be re-inserted between his outer wall 22 and inner wall 24. Henning shows no structure anywhere near that of the instant invention and his combining a straw and container does not in any way relate to the instant invention. The instant invention is not merely a container with a straw attached by means of a stopper but is rather a combination of various structures, the combination of which yields a novel and unobvious advance over the prior art. Henning's container is in the form of a standard cup as compared to the instant helix-shaped transparent hollow container 4, the only similarity between the two is that they both contain liquid. However the flow of the fluid in the instant invention in container 4 is most significant since it serves several unique and distinct functions none of which are suggested in any of the prior art either singly or in combination.

In the instant invention it is the visual effects that are of paramount importance: A child (or adult) will be fascinated when filling the container by first the downward movement of the swirling liquid and then by the liquid changing its direction by 180 degrees in an upward movement into straw 9 as soon as the fluid reaches the base. When funnel 1 is removed and the user starts to consume the liquid, the liquid will rise in the straw and the faster the liquid is consumed the faster the liquid will swirl down container 4 and up straw 9. Additionally when the apparatus is filled and static, the liquid level in container 4 and 9 are the same thus illustrating to a child the physical laws of gravity.

Mimmack U.S. Pat. No. (794,996) is simply a device so that a patient may easily take a prescribed amount of medicine without rising. Neither Mimmack or Henning rely nor do they claim any visual effects of the fluid contained in their respective receptacles and hence it cannot be said that the instant invention is anticipated by either of them, the similarity between these two devices and the instant invention being only that both store liquid.

Gildersleeve U.S. Pat. No. (2,063,803) is merely a drinking straw provided with a circuitous passage and teaches nothing more. Absent from Gildersleeve is any suggestion as to the use of his straw with any type of receptacle other than an ordinary drinking cup shaped drinking container to which it is unattached.

Other U.S. Pat. Nos. located in the prior art are Owen (2,223,528), Stone (D217001), Fowler (162,640), Lewis (1,215,823), Cunningham (2,687,628) and Harrigan (3,645,262) and foreign patent Lewis (3124). However all the cited references differ vastly in numerous essential respects from the present invention and upon comparison of the cited patents it is clear that the present invention is an advancement over said art as hereinafter set forth.

PRIOR ART STATEMENT

On information and belief the present invention is not shown or described in any patent, publications or elsewhere. However, the applicant specifically states that the only patents that he is aware of are disclosed herein and to the best of his knowledge he has disclosed herein the closest prior art he is aware of.

SUMMARY AND OBJECTS OF THE INVENTION

It is therefore an object of this invention to provide a helix-shaped transparent hollow container formed in the shape of a helix with a transparent drinking straw attached to one end.

Another object of this invention is to provide an attractive and interesting container in order to encourage a child to drink therefrom healthy liquids such as milk, juices, and the like which they might not otherwise consume.

Another object of this invention is to provide a container which when a child sees being filled will attract the child's attention so that the child will be receptive to drinking the contents thereof.

Another object of this invention is to provide a container which when a child sees being emptied by the drinking of the contents will attract the child's attention so that the child will be encouraged to consume the contents thereof.

A further object of the invention is to provide a storage vessel for the liquid if said liquid is not consumed at one time.

A still further objective of this invention is to illustrate to a child the elementary principals of the way fluid reacts in first going in a downward direction when filling the container and then in an upward direction as well as that the liquid in both tubes will come to rest at the same level.

Briefly, one embodiment of this invention includes a helix-shaped transparent hollow container for storage of drinking fluid such as milk and juice. One end of the helix-shaped transparent hollow container is flat for a portion of its circumference in order that it will stand upright on a table. Affixed to the bottom end of the flat portion of the container is a transparent hollow drinking straw for drinking the liquid in the container, the upper most portion of said straw being level or higher than the top of the container in order to retain the liquid in the container when not being used.

A removable funnel is used to fill the helix-shaped transparent hollow container. During the filling of the container fluids such as milk and juice spiral downward through the helix-shaped transparent container. When the liquid reaches the bottom most portion of the container the liquid will then begin to rise into the spiral-shaped transparent straw and will continue to rise until the level in both sections are the same. The spiral flow of the fluid initially downward and then up in an opposite direction is fascinating to a child and holds his interest.

When the liquid is consumed and drawn by suction through the straw the liquid level will fall in the helix-shaped transparent hollow container and will rise in the straw which will also attract and make the consumption of the liquid enjoyable to a child.

A stopper is provided to provide a sanitary container for storage in the event the total contents are not consumed.

The invention can be easily disassembled for easy cleaning and reuse.

When the invention is used in conjunction with a nasogastric tube or similar type tube for feeding patients who cannot consume nutrients in the normal manner it acts as a feeding container. The novelty effect of the liquid in motion makes it more enjoyable for the patient to consume his nutrients and for anyone who helps or sees the patient it eases the trama of this type of feeding as for example his family. Children especially who need to be tube-fed will now have something to look forward to.

So too children suffering from anorexia will find it enjoyable to watch the swirling action of the liquid in the invention and their eating problems will be reduced.

DETAILED DESCRIPTION OF THE INVENTION

Figure 1:
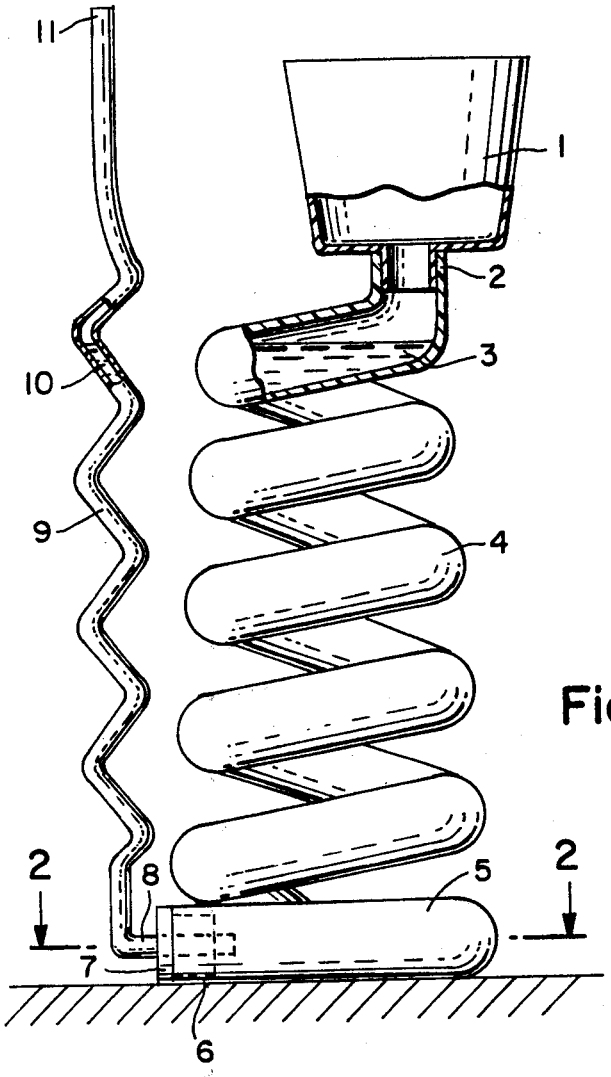
FIG. 1 is a perspective view of this invention.
Figure 3:
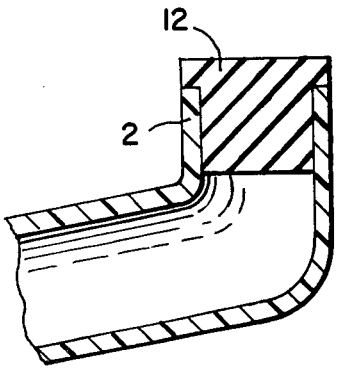
FIG. 3 is a sectional view of the upper-most portion of FIG. 1 with the funnel removed and stopper in place for storage of liquid in the container.
Figure 2:
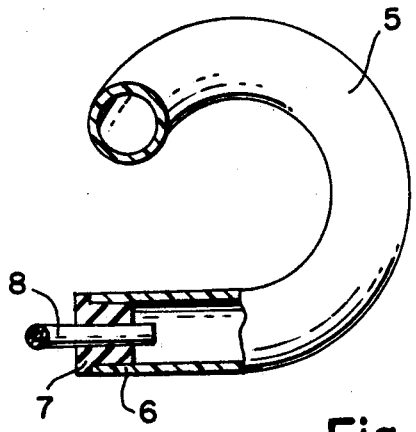
FIG. 2 is a partial sectional view along line 2—2.

FIG. 1 shows a helix-shaped transparent hollow container 4 which has a straight vertical section 2 designed so that funnel 1 or stopper 12 will fit into the inside of said section. The preferred size of container 4 is 36½ inches long (when fabricated from a straight piece of hollow tubing) with an outside diameter of the tube of 1 inch and a wall thickness of 1/16 inch and consists of 5½ coils with an overall height of 10½ inches. The bottom most coil 5 of container 4 is flat for approximately 75 percent of its circumference and forms its base which enables container 4 to lie flat on a table. The end of coil 5 has a straight section 6 wherein stopper 7 is attached. Stopper 7 is rubber or a similar material and makes a leak-tight seal between the inside diameter of section 6 and also between bottom end 8 of straw 9.

Straw 9 is a spiral-shaped transparent hollow tube the lower most section 8 connected to and through stopper 7 so that liquid in section 5 is communicated to straw 9. Upper most section 11 of straw 9 is straight and extends beyond the top of section 2 for two inches in order that liquid level 3 is contained within this invention without spilling out of top 11 of straw 9. The preferred size of straw 9 is ¼ inch outside diameter with a wall thickness of 1/32 to 1/16 inch. When fabricated from a straight piece of hollow tubing it measures 2 feet long before shaping into a spiral. As shown the straw is spiral shaped, all spirals being the same diameter.

Funnel 1 is used to fill container 4 to liquid level 3 and 10 and is then removed. During the filling of container 4, liquid such as milk, juice and the like swirls downward through helix-shaped transparent container 4 and when the liquid reaches section 5 the liquid then swirls upward through section 8 of straw 9 until level 10 is equal to that of level 3.

A child will be fascinated by first the downward swirling movement of the liquid in container 4 and then by the abrupt 180 degree change in direction when the liquid reaches section 5 with the liquid then moving spirally upwards. When the liquid is withdrawn by suction and then consumed from end 11 of straw 9 liquid level 3 in container 4 will begin to fall while liquid level 10 will rise in section 11 said liquid movement being an incentive for the child to drink.

When it is desired to store liquid in the container stopper 12 is inserted into section 2 and the container becomes a sanitory container.

The preferred material of construction for helix-shaped transparent hollow container 4 and for spiral-shaped transparent straw 9 is non-toxic clear plastic material of any type so long as it is approved by the Food and Drug Administration. However any material compatable with food as well as any color material can be sucessfully used. Stopper 7 and 12 are constructed from rubber or any other type of soft material so long as approved by the Food and Drug Administration.

By substituting for straw 9 a nasogastric tube or similar type tube the invention is then used for feeding patients who cannot consume nutrients in the normal manner. The novelty of seeing the movement of the liquids reduces the trama of this type of feeding for both the patient and on-lookers such as his family and the invention eliminates pouring the liquid to be consumed into a funnel as is presently done.

This invention is intended to cover all changes and modifications of the invention which fall within the scope of the invention which include but are not limited to changes in size, shape, color and alike.

Having regard to the foregoing disclosure, the following is claimed as the inventive and patentable embodiments thereof:

1. A container for storage and drinking, which comprises:

a. a helix-shaped transparent container which directs liquid in a downward swirling movement during filling, said container comprising of a hollow tube structure, said hollow tube structure containing the liquid to be consumed;

b. a base at the bottom most end of the container said base formed from the bottom most coil of the container said bottom coil formed flat for approximately seventy-five percent of its circumference;

c. a spiral shaped transparent straw, the top of said straw extending beyond the top of the container so as to keep the fluid in the container from coming out of the top of the straw due to gravity, the straw formed to permit liquid from the container to be received by the straw in an upward swirling movement during the filling of the container and during drinking giving a fascinating visual effect; and d. a stopper to connect the straw to the container and to communicate the liquid from the container to the straw.

2. A container for storage and drinking as recited in claim 1, wherein the upper most end of the helix-shaped transparent container is provided with a straight vertical section for easy filling with a funnel and to permit sanitary storage of unconsumed liquid by means of inserting a stopper into its open end.

* * * * *